US006412244B2

(12) United States Patent
Nolan

(10) Patent No.: US 6,412,244 B2
(45) Date of Patent: Jul. 2, 2002

(54) MODULAR WALL ELEMENT

(76) Inventor: Edward Nolan, Ballysax, The Curragh, Kildare (IE)

( * ) Notice: Subject to any disclaimer, the term of this patent is extended or adjusted under 35 U.S.C. 154(b) by 0 days.

(21) Appl. No.: 09/396,551

(22) Filed: Sep. 3, 1999

(30) Foreign Application Priority Data

Sep. 3, 1998 (IE) ..... S980738

(51) Int. Cl.[7] ..... B44F 7/00
(52) U.S. Cl. ..... 52/315; 52/293.2
(58) Field of Search ..... 52/299, 293.2, 52/592.1, 604, 315

(56) References Cited

U.S. PATENT DOCUMENTS 1,916,308 A * 7/1933 Grieco ..... 52/315
1,933,237 A * 10/1933 Aberson ..... 52/315
2,054,679 A * 9/1936 Nelson ..... 52/315
2,122,696 A * 7/1938 Poston ..... 52/315
2,266,510 A * 12/1941 Pottinger ..... 52/315
3,775,916 A * 12/1973 Bair ..... 52/315 X
3,868,801 A * 3/1975 Weiner ..... 52/315 X
4,223,502 A * 9/1980 Robinson ..... 52/315
4,589,241 A * 5/1986 Volpenhein ..... 52/315
4,903,450 A * 2/1990 Adams ..... 52/293.2
5,715,637 A * 2/1998 Hesterman et al. ..... 52/315
5,787,667 A * 8/1998 Sheahan et al. ..... 52/315

* cited by examiner

*Primary Examiner*—David M. Purol
(74) *Attorney, Agent, or Firm*—Jacobson Holman, PLLC

(57) ABSTRACT

A prefabricated modular wall element (20) comprises a precast reinforced concrete wall panel (21) having a front face (24). A plurality of spaced-apart individual slabs (33) of stone or brick are partially embedded in the front face (24) of the panel (21) during casting of the panel (21) and project outwardly of the front face (24) with channels being formed between the slabs (33). The slabs are arranged on the front face (24) such that the front face (24) simulates a wall constructed of stone. A pair of spaced-apart support legs (38) are provided at a bottom (27) of the wall panel (21) for keying into a concrete foundation (42) to support the wall element (1) in an upright.

20 Claims, 14 Drawing Sheets

MODULAR WALL ELEMENT

This invention relates to a prefabricated modular wall element.

BACKGROUND OF THE INVENTION

Generally speaking, the construction of decorative skills such as boundary walls or exterior walls in houses tends to be relatively time consuming and expensive and also skilled bricklayers or masons are required to build the wall. Foundations have to be laid and then typically a block or brick wall is built on the foundations. For constructing a stone wall, the procedures is even more time consuming with the construction of a stone wall on one or both sides of a backing wall of blocks or the like. There are also problems with theft of the stone building materials and vandalism using the stone when the stone is on site awaiting construction of the wall.

The present invention is directed towards overcoming these problems.

SUMMARY OF THE INVENTION

According to the invention, there is provided a prefabricated modular wall element comprising a precast reinforced concrete wall panel having a front face with a plurality of spaced-apart individual slabs of stone or brick partially embedded in the front face of the panel and projecting outwardly therefrom having channels formed between the slabs, said slabs being arranged on the front face such that the front face simulates a wall constructed of stone or brick building elements.

In a particularly preferred embodiment, stone slabs are arranged on the front face to give the impression of a solid stone wall.

It will be appreciated that advantageously the modular wall elements can be readily easily mass manufactured in a factory environment and then transported on site, a number of the panels being supported upright edge to edge to rapidly form the decorative wall. The skill required to build a natural stone, brick or block wall is not needed and the wall can be constructed by unskilled labourers which provides a further cost saving for the builder.

In a particular preferred embodiment, two or more spaced-apart support legs are provided at a bottom of the wall panel. This is a particularly convenient feature in that to support the panel, a foundation trench can be dug and then the panel stood upright in the trench. With the panel supported upright, concrete is poured into the trench covering the bottom of the panel, the legs on the panel keying the panel into the concrete foundation. It will be appreciated that this greatly simplifies wall construction as a number of panels are simply supported end to end along a foundation trench which is then infilled with the concrete foundation material which, when it sets, provides a rapidly constructed wall.

In another embodiment, the legs are integrally formed with the wall panel.

In a further embodiment, the legs project forwardly and rearwardly of the front face and a rear face respectively of the wall element.

In another embodiment, each leg has a slot in the top of the leg for complementary reception of a bottom of the wall panel.

In a further embodiment, the wall element has means for interlocking a pair of the wall elements end to end.

In a preferred embodiment, said interlocking means is a tongue and groove joint, a tongue being provided along one end face of the wall panel and a groove being provided in an opposite end face of the wall panel. Thus conveniently, when assembling a wall, a tongue at an end of one panel engages a complementary groove in the abutting edge of an adjacent panel.

It will be appreciated that two separate panels might be provided, one panel with tongues at both ends and the other panel with grooves at both ends, alternate types of panels being arranged in line to form the wall.

For corner joints, panels may be provided with bevelled ends.

In another embodiment, a capping element is provided for engagement with a top of the wall. To allow capping of the wall, slots may be provided along a top face of the wall panel with associated capping elements engaging with the slots to secure the capping elements on the top of the wall panel.

Also, if desired, the wall panel may be in the shape of a pier for mounting at an end of a run of panels, say for defining an entrance or the like.

In a preferred embodiment, grouting such as cement or mortar is provided in the channels between the slabs. This has to further give the impression that the wall formed of the panels is a natural stone or brick wall.

In a particularly preferred embodiment, the slabs are embedded in the concrete panel to a depth of at least 38 mm. The thickness of the slabs is typically in the range 50–75 mm. Ideally, the wall panel should be at least 150 mm thick.

In a further embodiment, a rear face of the wall panel also has a plurality of slabs partially embedded therein such that the rear face simulates a wall constructed of stone or brick. This is obviously desirable where both sides of the wall are open to viewing.

In another aspect, the invention provides a method for manufacturing a modular wall element of the type described herein comprising the steps:

preparing a mould, placing a reinforcing mesh in the mould, pouring concrete into the mould, and before the concrete sets, embedding a plurality of the slabs in the concrete.

In a still further aspect, the invention provides a method for constructing a wall comprising a number of the modular wall elements comprising the steps:

preparing a foundation trench, mounting a number of the wall elements end to end in the trench, pouring concrete into the trench, said concrete encasing a bottom of each wall element to form a foundation in which the wall element are embedded.

BRIEF DESCRIPTION OF THE DRAWINGS

The invention will be more clearly understood by the following description of some embodiments thereof, given by way of example only, with reference to the accompanying drawings, in which.

DESCRIPTION OF THE PREFERRED EMBODIMENT

Figure 2:
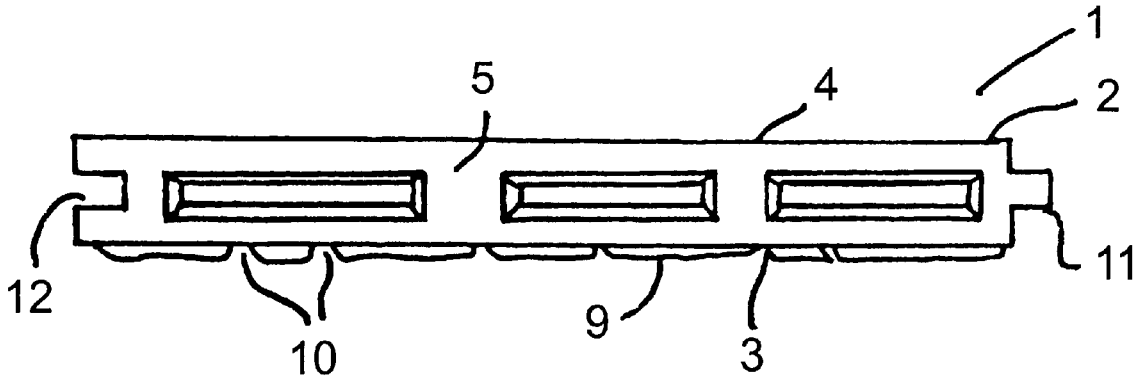
FIG. 2 is a plan view of the wall element.
Figure 1:
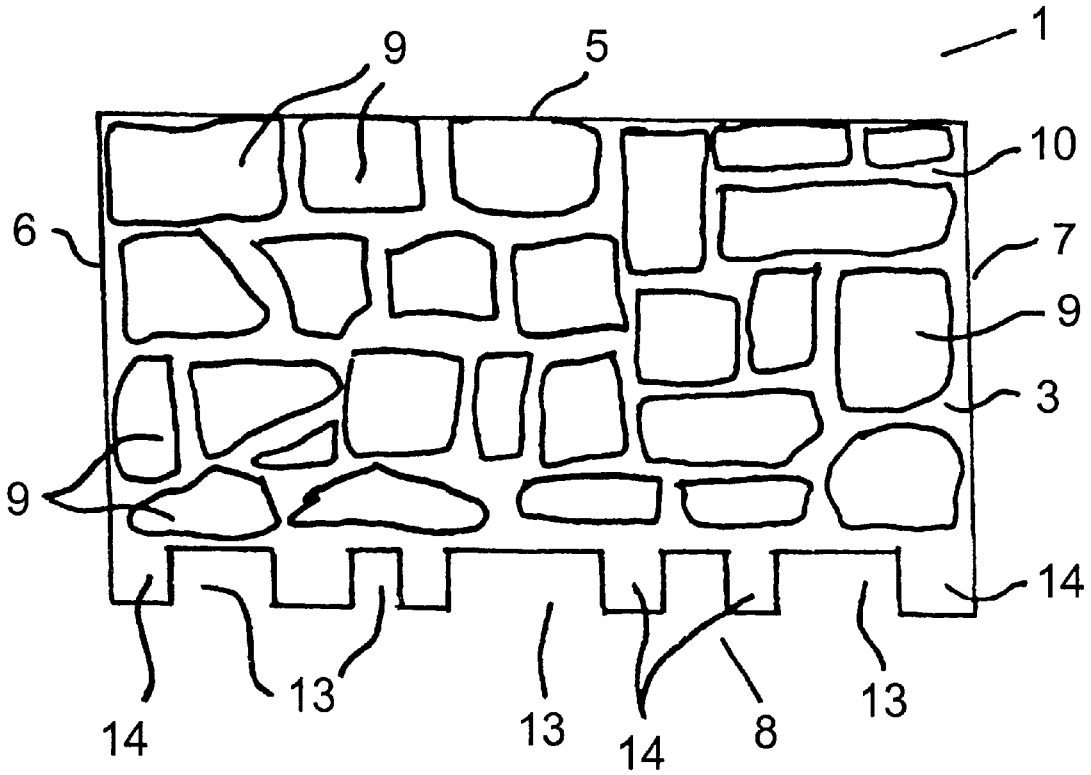
FIG. 1 is an elevational view of a wall element according to the invention.

Referring to the drawings, and initially to FIGS. 1 and 2 thereof, there is illustrated a prefabricated modular wall element according to the invention, indicated generally by the reference numeral 1. The wall element 1 comprises a precast reinforced concrete wall panel 2 having a front face 3, rear face 4, top face 5, end faces 6, 7 and bottom 8. A number of spaced-apart thin stone slabs 9 are embedded in the front face 3 of the wall panel 2 to give the impression of a solid stone wall. Grouting is inserted in the channels or slots 10 between adjacent stone slabs 9.

In the manufacture of the wall element 1, reinforcing meshes are placed in a mould and then the concrete is poured into the mould. While still wet, the stone slabs 9 can be mounted or the upper face of the wall panel 2 to securely embed the slaps 9 in the front face 3 of the wall panel 2.

In use, a foundation trench is dug for a wall. A number of the wall elements 1 are then mounted end to end in the trench to form the wall, the wall elements 1 interlock there being provided a tongue 11 and an associated groove 12 at opposite ends of the wall panel 2 so that adjacent wall elements 1 can interlock. It will be noted that any other suitable interlocking or overlapping arrangement may be provided for interengagement of adjacent panels. With the wall elements 1 supported in an upright position, concrete foundation material is then poured into the trench and filled above slots 13 formed between downwardly projecting legs 14 at the bottom 8 of the panel 2. Thus, each wall element 1 is keyed into the foundations and securely supported in an upright position on the foundations.

It will appreciated that the stone slabs 9 may be in any suitable type or colour of stone. As an alternative to stone, brick slabs or tiles might be used to simulate a brick wall.

Figure 3:
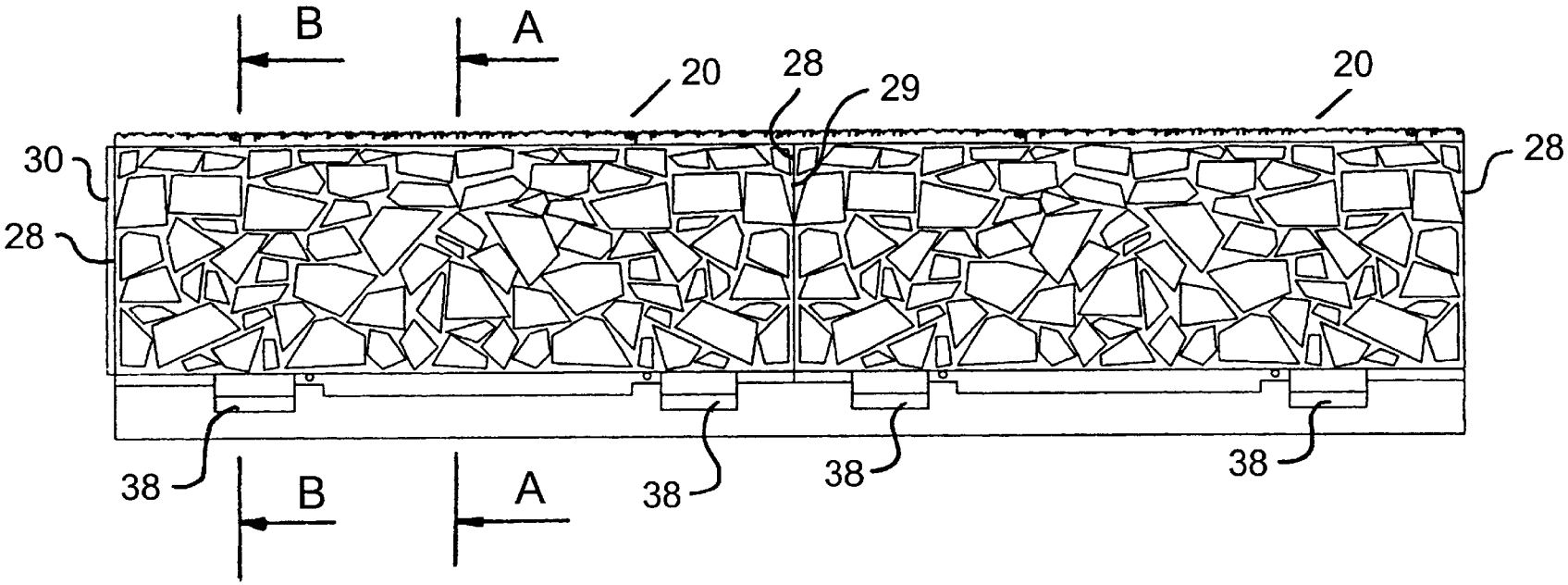
FIG. 3 is a front elevational view showing a pair of modular wall elements according to another embodiment of the invention.
Figure 4:
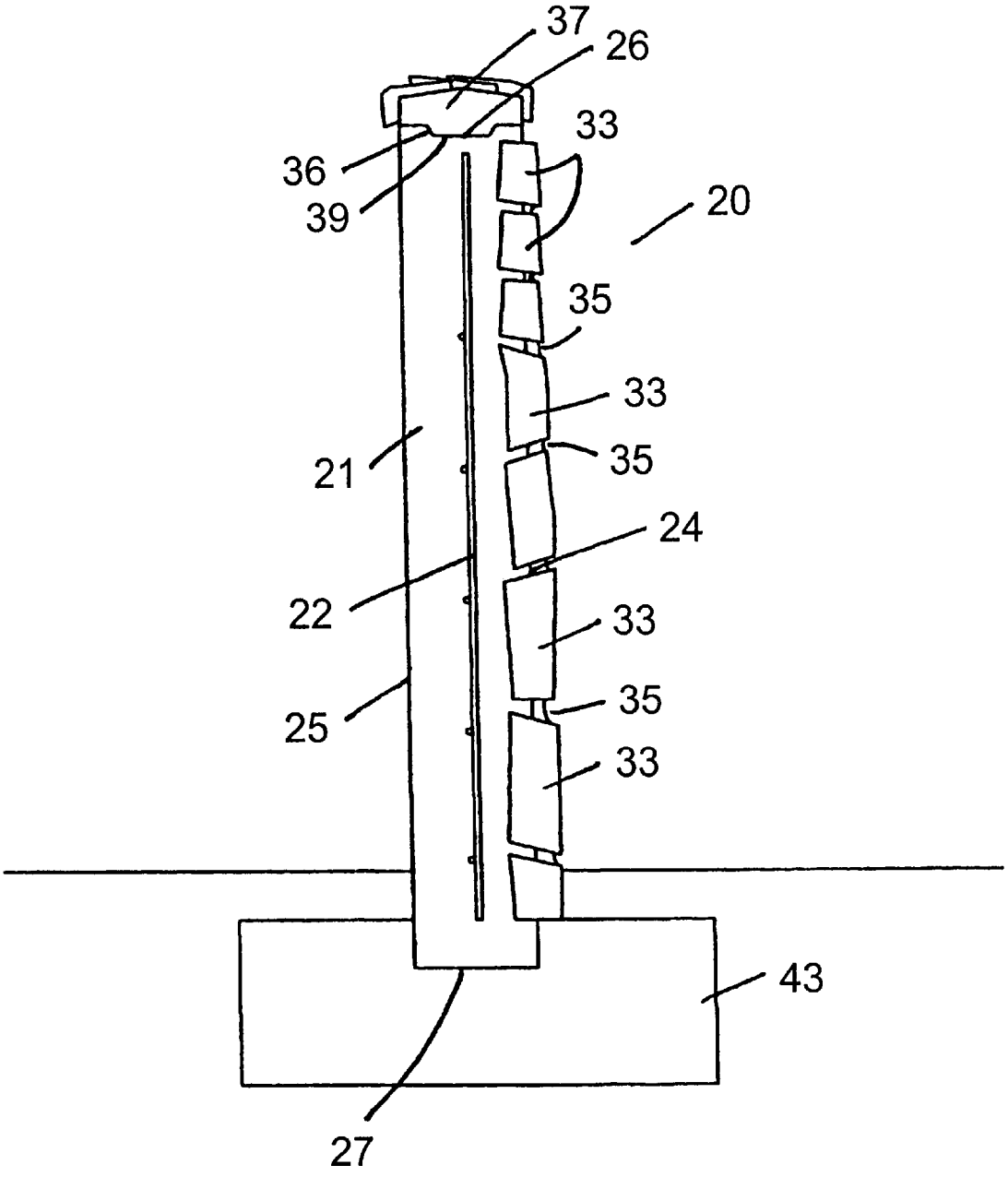
FIG. 4 is a sectional view taken along the line A—A of FIG. 3.

Referring to FIGS. 3 to 6, there is shown another wall element indicated generally by the reference numeral 20. In FIG. 3, two of the wall elements 20 are shown in end to end engagement. Each wall element 20 has a precast reinforced concrete wall panel 21 with a reinforcing steel mesh 22 embedded in the wall panel 21. The wall panel 21 has a front face 24, a rear face 25, a top 26 and a bottom 27. End faces 28, 29 have a tongue and groove interlocking arrangement as previously described, a tongue 30 being shown on one of the wall panels 20 in FIG. 3.

In this case, the rear face 25 has a fair faced concrete finish. A plurality of spaced-apart individual stone slabs 33 are embedded in the front face 24 of the wall panel 21. The slabs 33 are embedded to a depth of at least 38 mm. The slabs 33 are typically in the order of 50 to 75 mm thick. The wall panel 21 itself is preferably at least 150 mm thick. It will be noted that mortar or concrete grouting 35 is provided in channels between the slabs 33. The overall effect of the front face of the wall element 20 is such that it simulates a natural stone wall as shown in FIG. 3.

Precast concrete capping elements 37 are mounted at the top 26 of the wall panel 21. Each capping element 37 has a projection 36 which locates within a complementary recess 39 in the top 26 of the wall panel 21. This allows the capping element 37 to be securely mounted on top of the wall panel 21.

Figure 5:
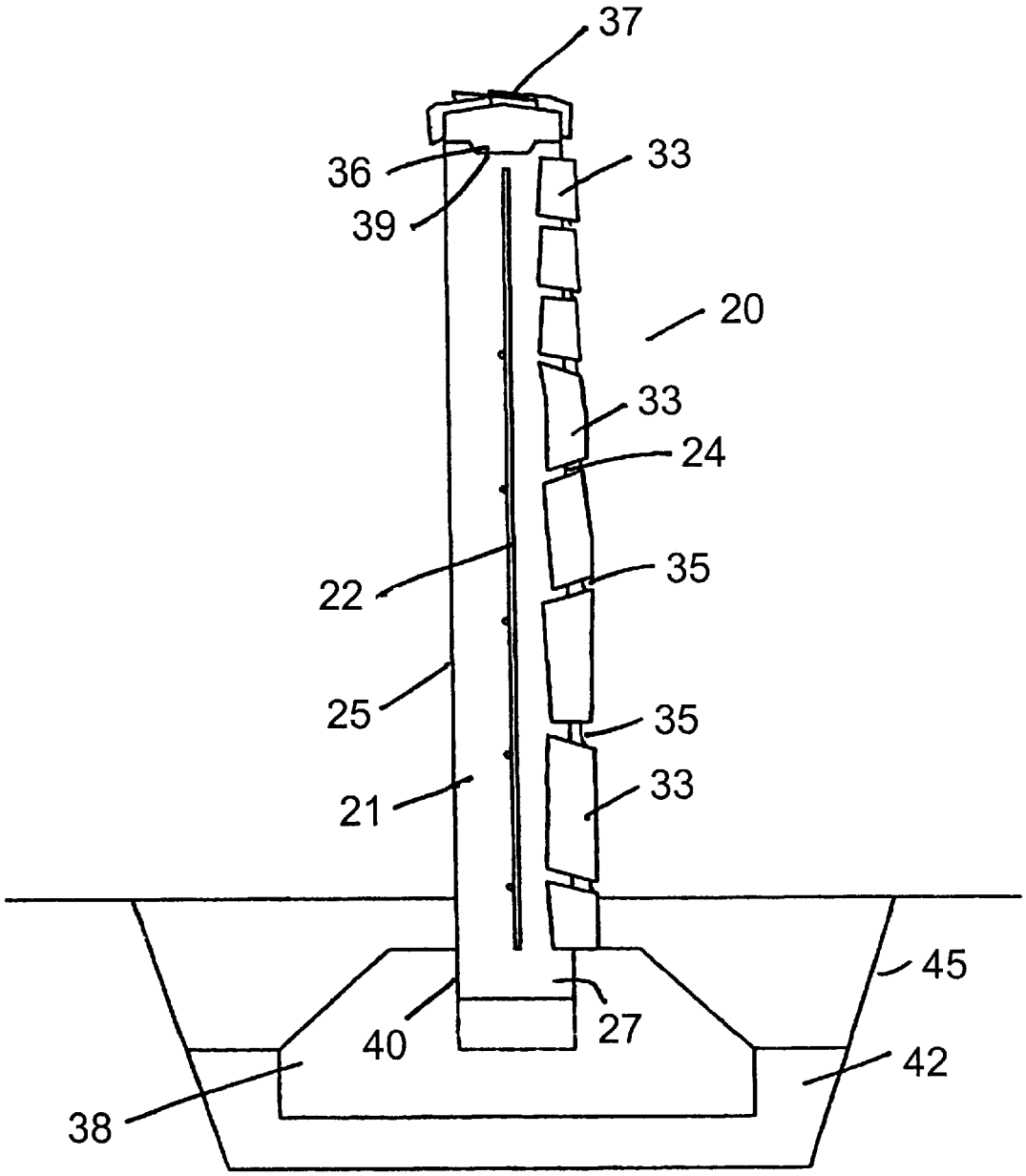
FIG. 5 is a sectional view taken along the line B—B of FIG. 3.

A pair of spaced-apart support legs 38 are mounted at a bottom 27 of the wall panel 21 and project outwardly to a front and to a rear of the wall panel 21 as shown in FIG. 5. In this case, the legs are also of precast concrete and have a socket or slot 40 for complementary reception of the bottom 27 of the wall panel 21. When constructing a wall, the legs 38 are embedded in a concrete foundation 42 in a trench 45 formed in the ground. Between the legs 38, the bottom 27 of the wall panel 21 is embedded in an in-situ concrete strip foundation 43 within the trench 45. After in-filling the trench 45, the ground covers the bottom 27 of the wall panel 21 to give the impression from the front of a solid stone wall rising from the ground.

Figure 6:
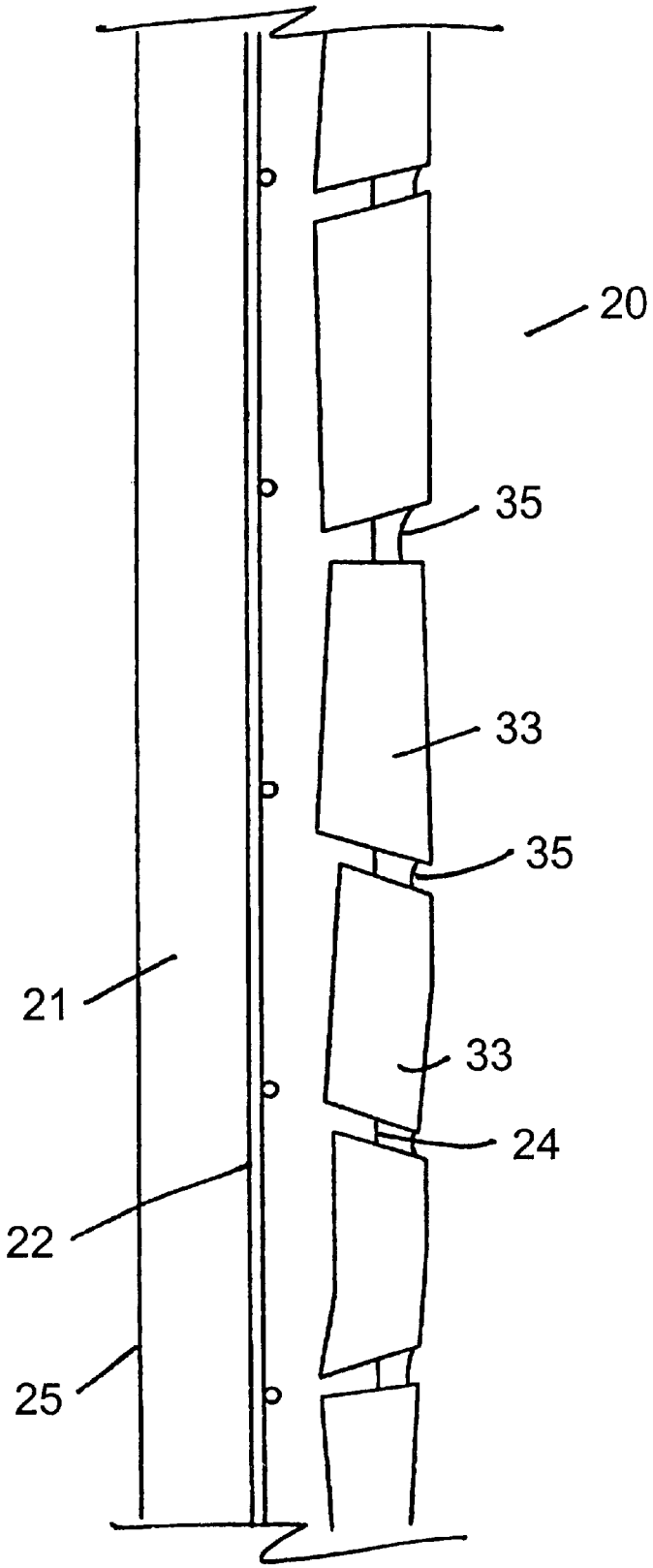
FIG. 6 is a detail sectional view of the wall element shown in FIG. 4.
Figure 7:
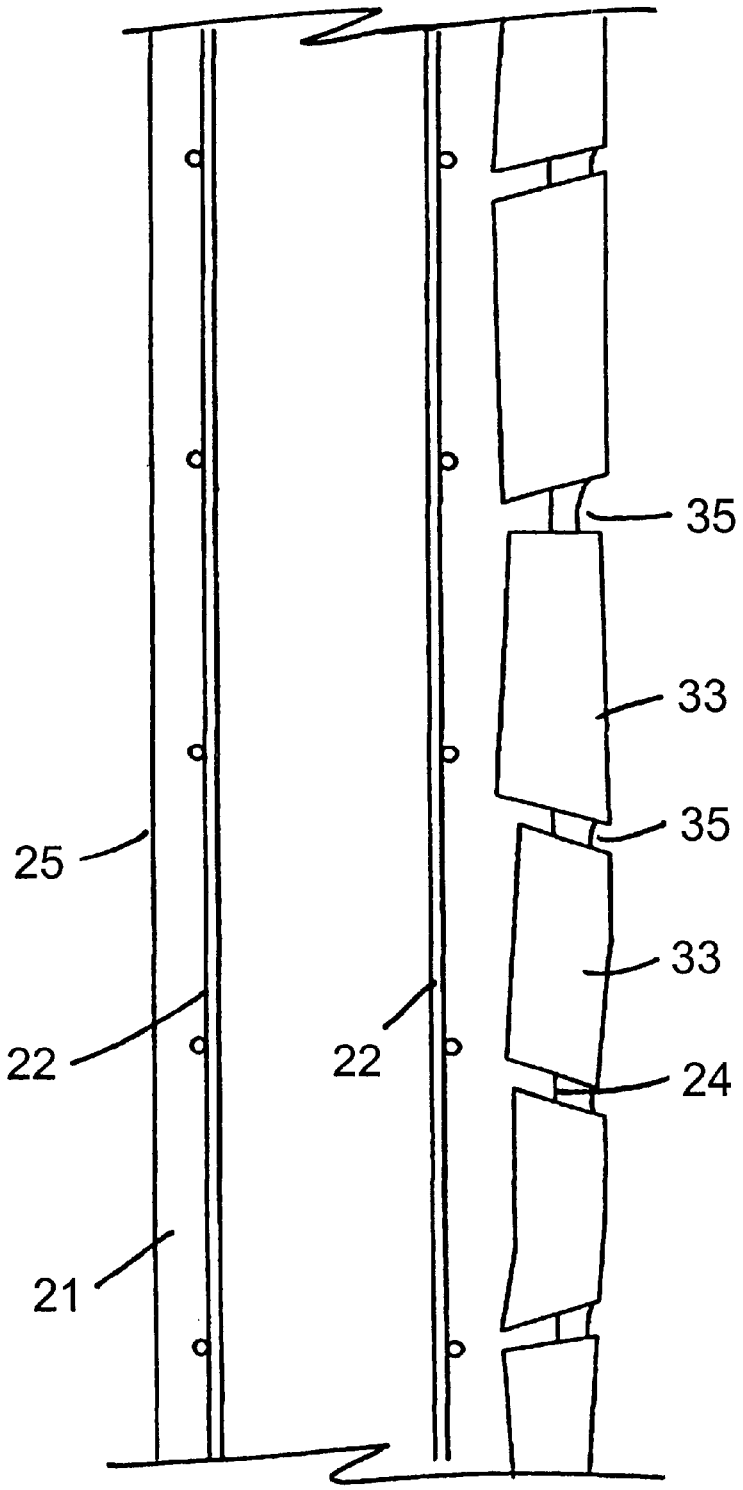
FIG. 7 is a detail sectional view similar to FIG. 6 showing an alternative construction of the wall element.

FIG. 7 is an illustration similar to FIG. 6 showing an alternative construction of the wall panel 21 which in this case is for a load bearing wall and accordingly, two layers of mesh reinforcement 22 are provided within the wall panel 21.

Figure 8:
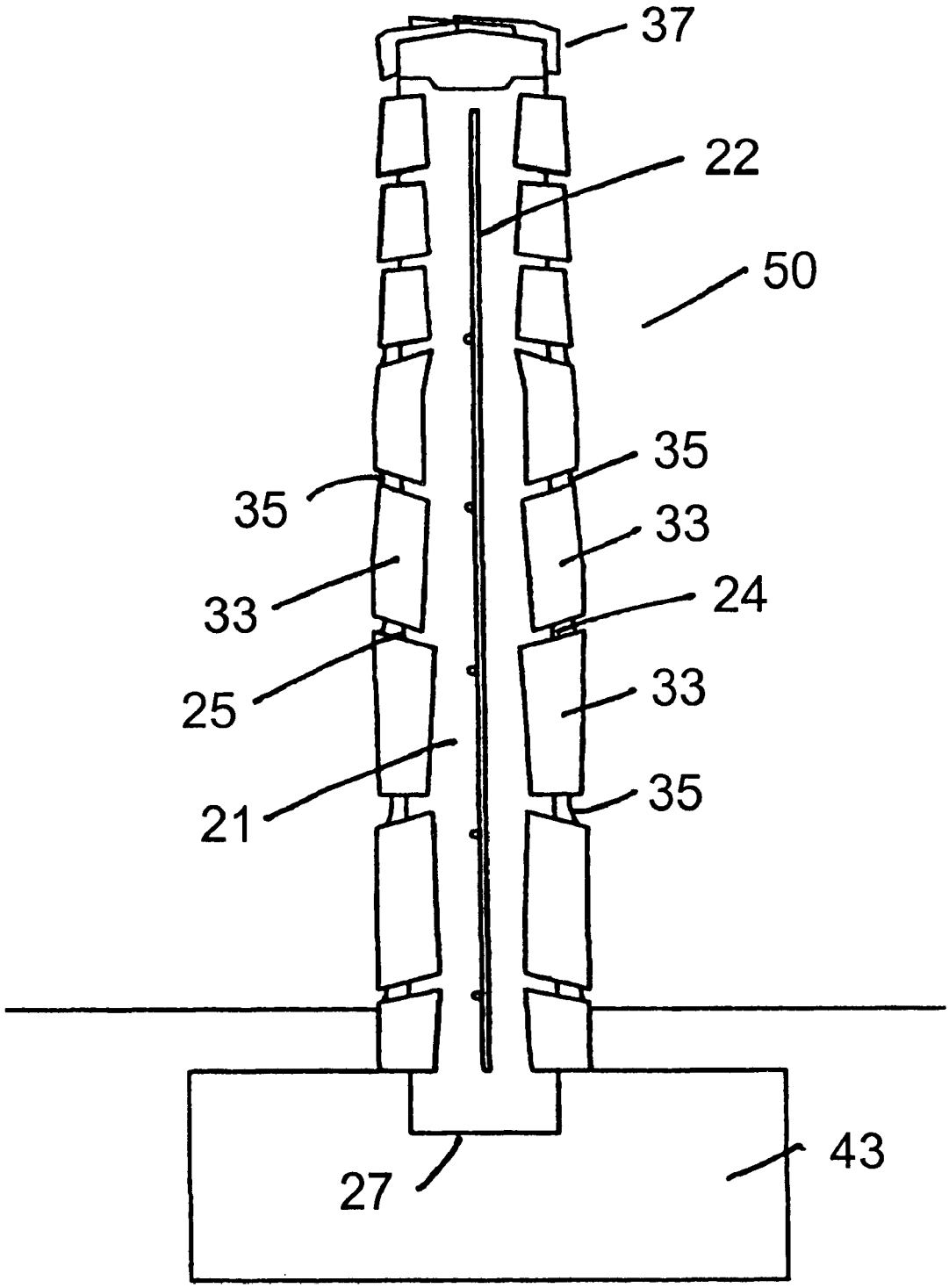
FIG. 8 is a sectional view corresponding to FIG. 4 of another wall element.
Figure 9:
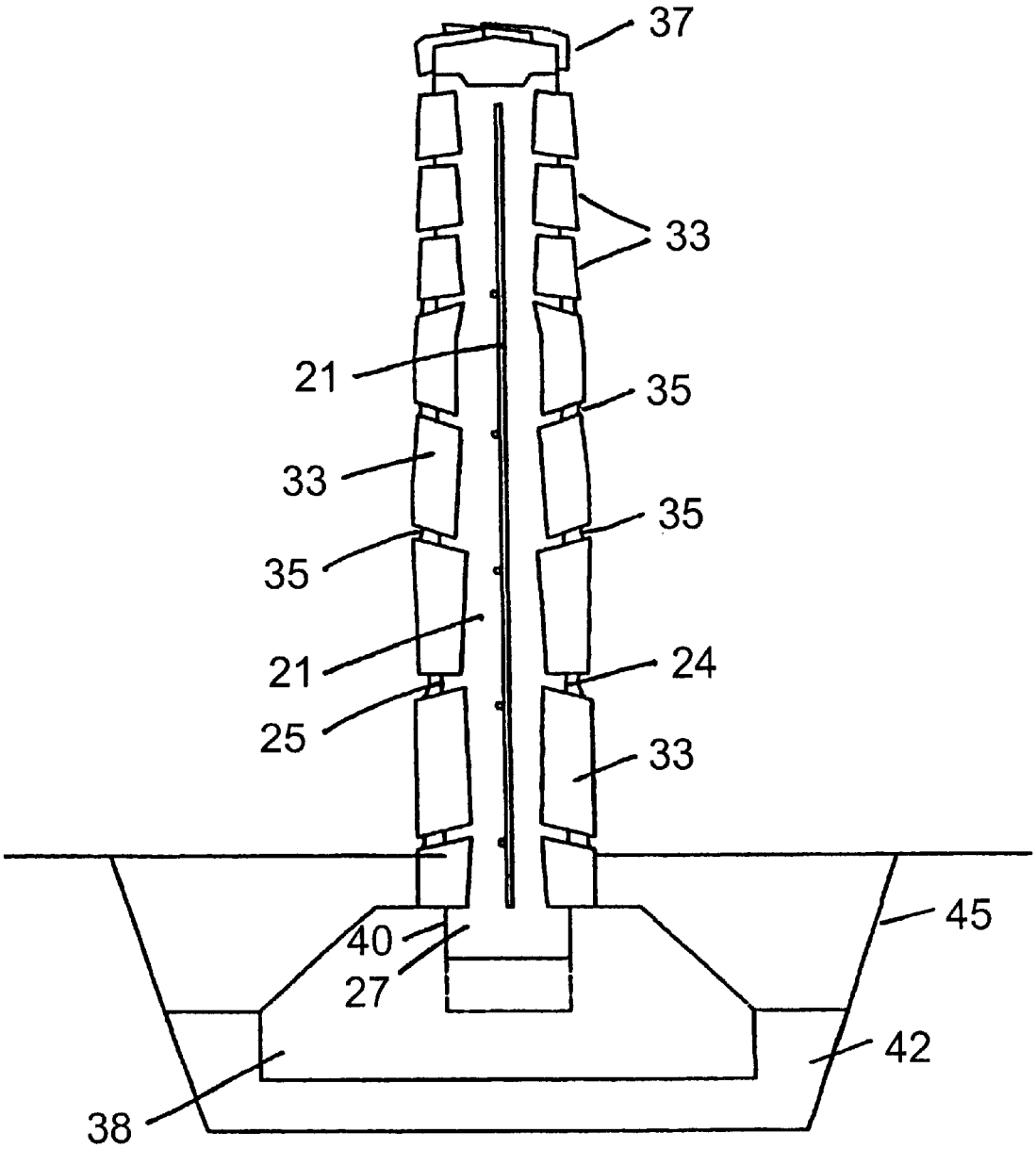
FIG. 9 is a sectional view corresponding to FIG. 5 of the wall element shown in FIG. 8.
Figure 10:
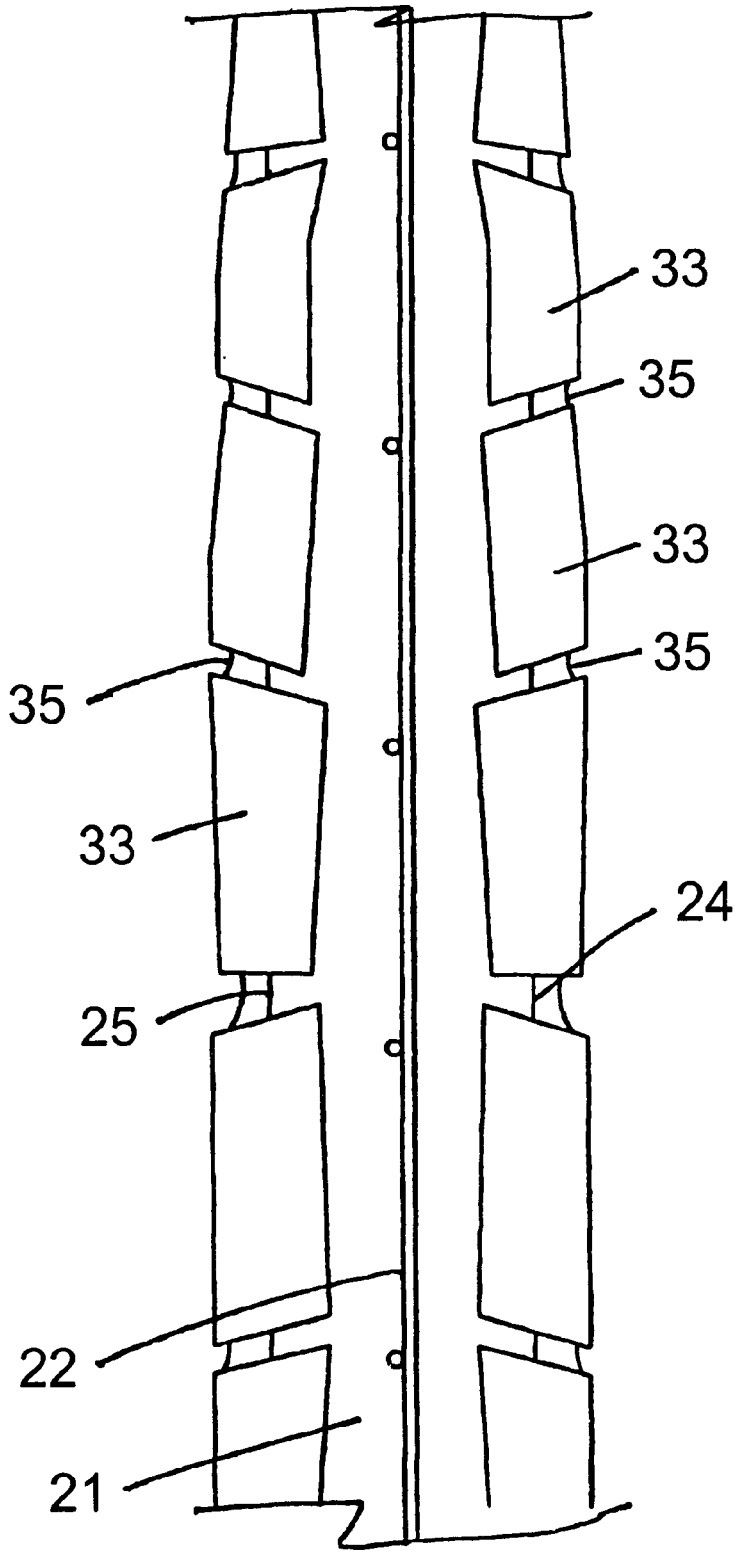
FIG. 10 is a detail sectional view of portion of the wall element shown in FIG. 8.

Referring now to FIGS. 8 to 10, there is shown another wall element indicated generally be the reference numeral 50. This is generally similar to the wall element described with reference to FIGS. 3 and 6 and like parts are assigned the same reference numerals. In this case, the stone slabs 33 are provided on the rear face 25 of the wall panel 21 in addition to the front face 24. Thus, a person viewing the wall from either side will have the impression of a stone wall.

Figure 11:
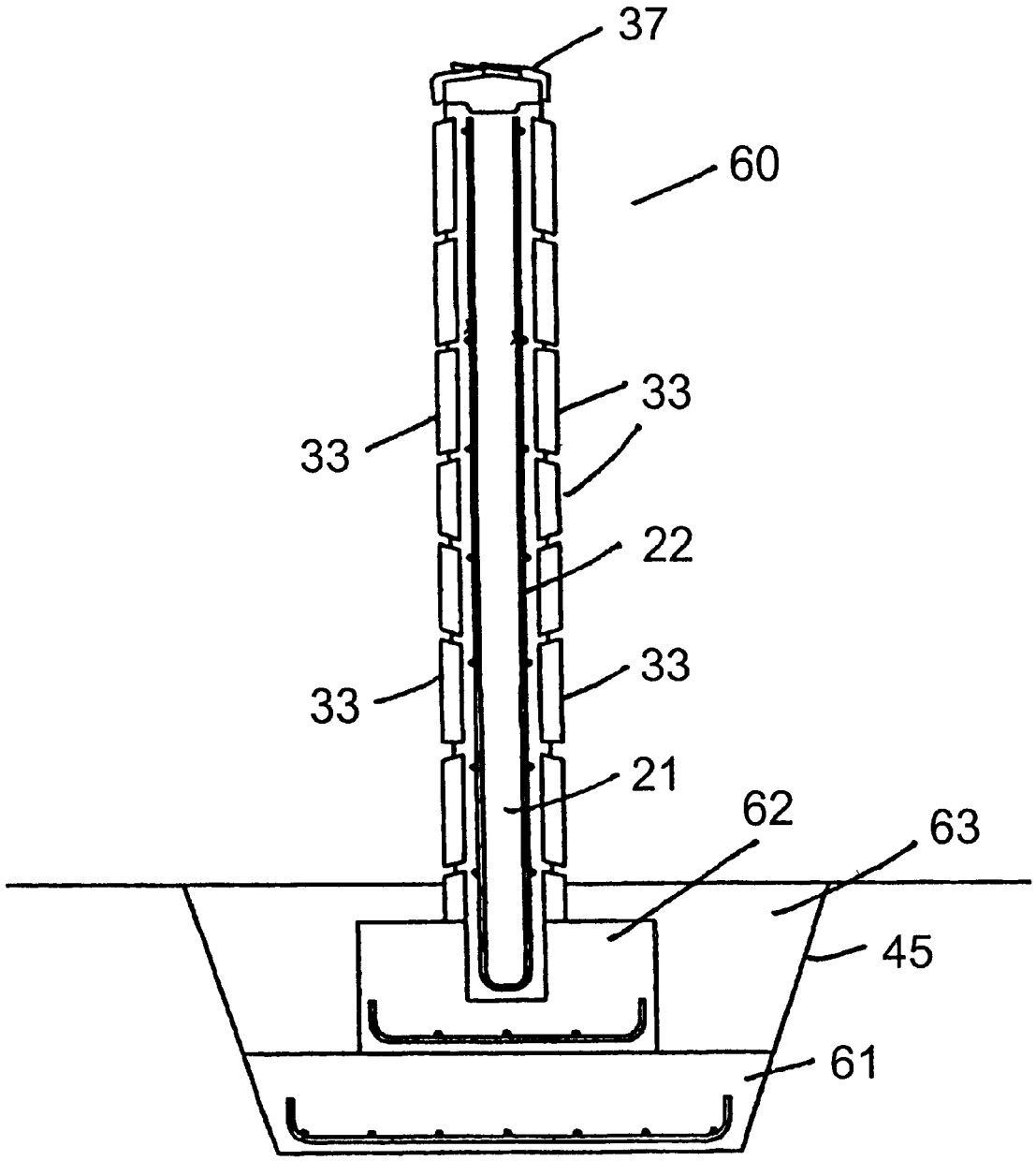
FIG. 11 is a sectional view corresponding to FIG. 4 of a further wall element.
Figure 12:
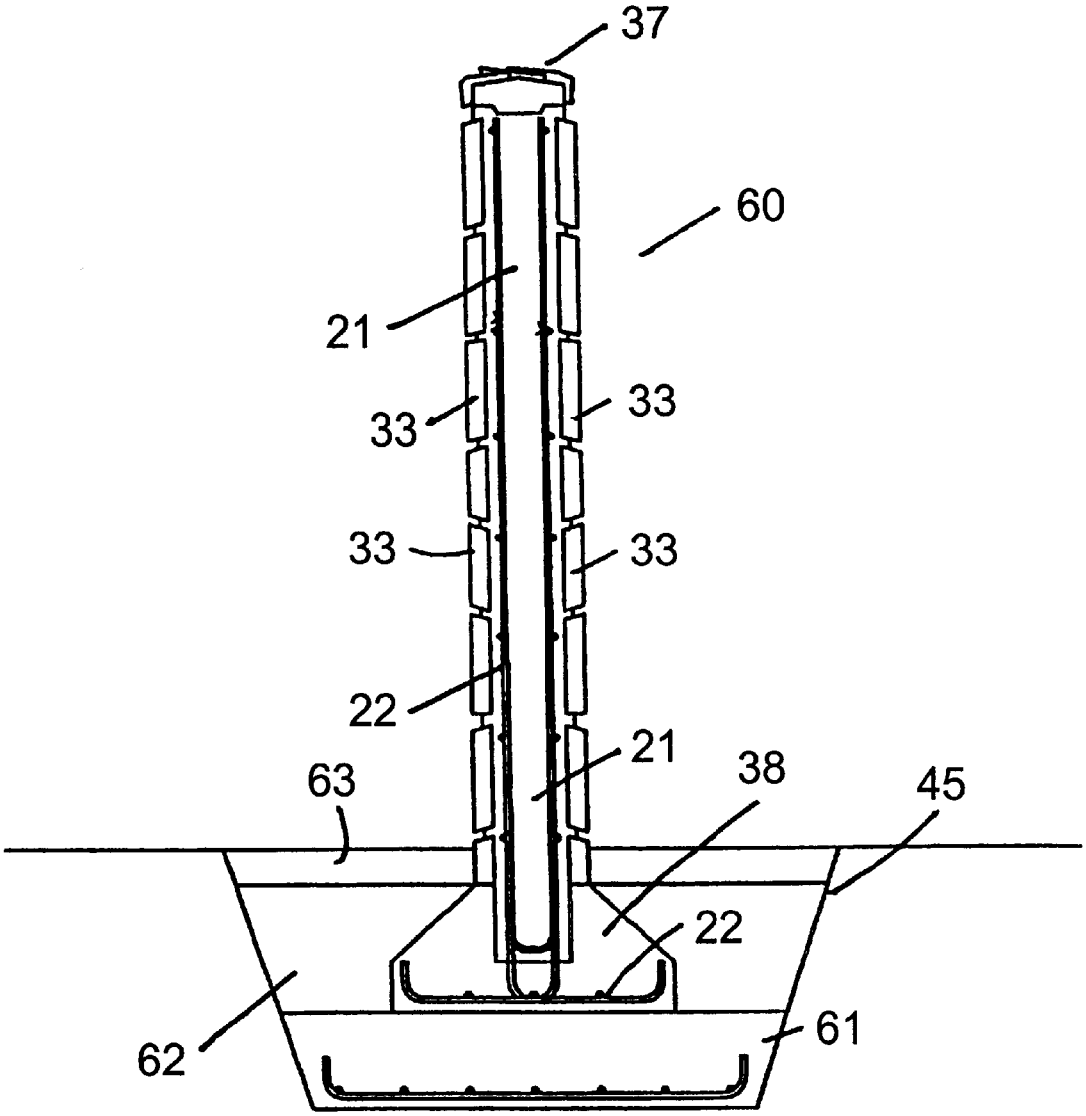
FIG. 12 is a sectional view corresponding to FIG. 5 of the wall element shown in FIG. 11.
Figure 13:
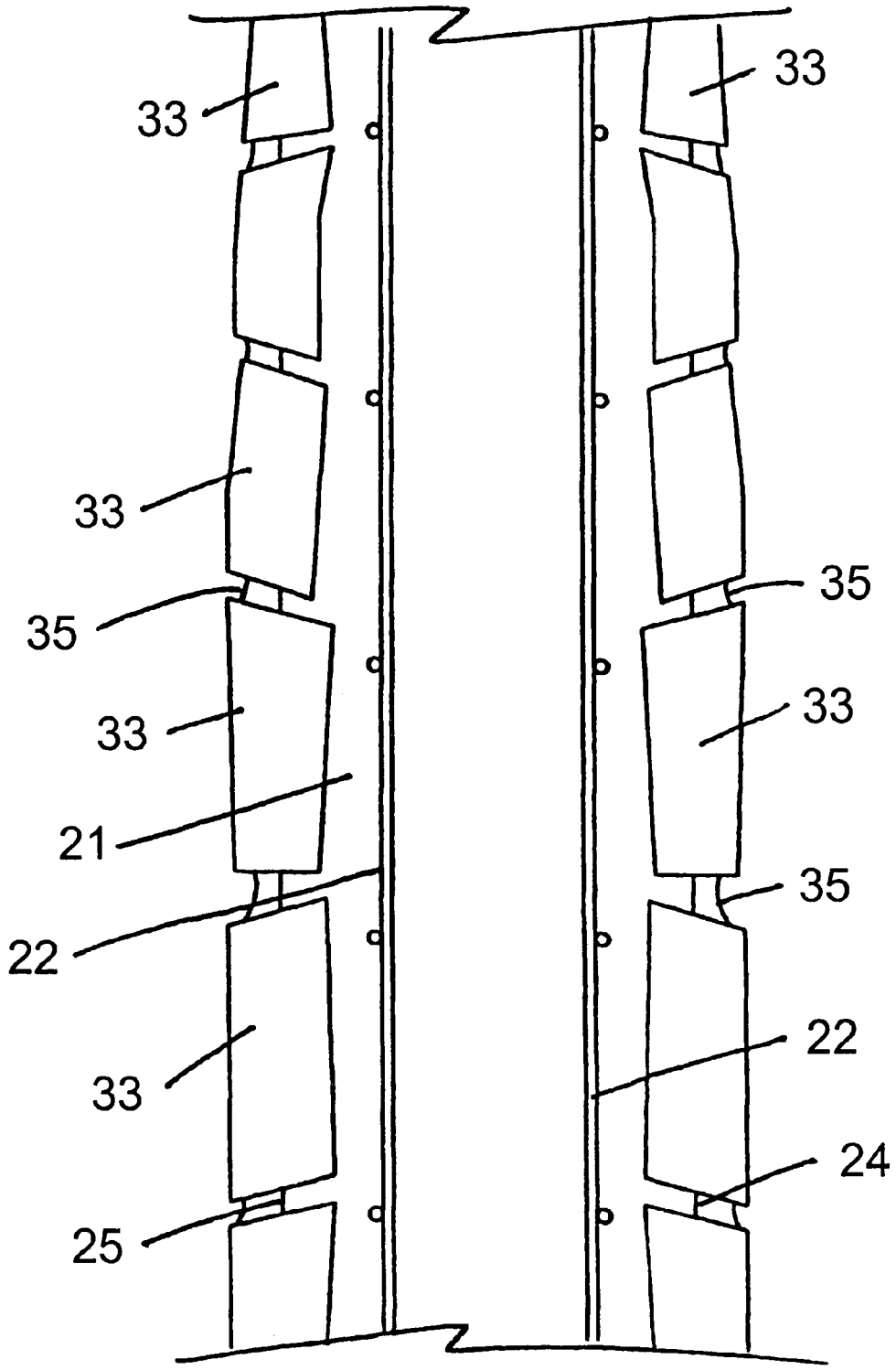
FIG. 13 is a detail sectional view of the wall element shown in FIG. 11.

Referring now to FIGS. 11 to 13, there is shown another wall element 60. Parts similar to those described previously are assigned the same reference numerals. In this case, the legs 38 are integrally cast with the wall panel 21. THe reinforcing elements 22 are extended downwardly into the legs 38. In this case also, the legs 38 are shown standing on a continuous reinforced concrete strip foundation 61 within the bottom of the trench 45. After the wall element 60 has been erected, concrete is poured into the trench 45 to form an in situ concrete layer 62 within which the legs 38 are embedded. Soil in-fill 63 is then provided above the layer 62.

Figure 14:
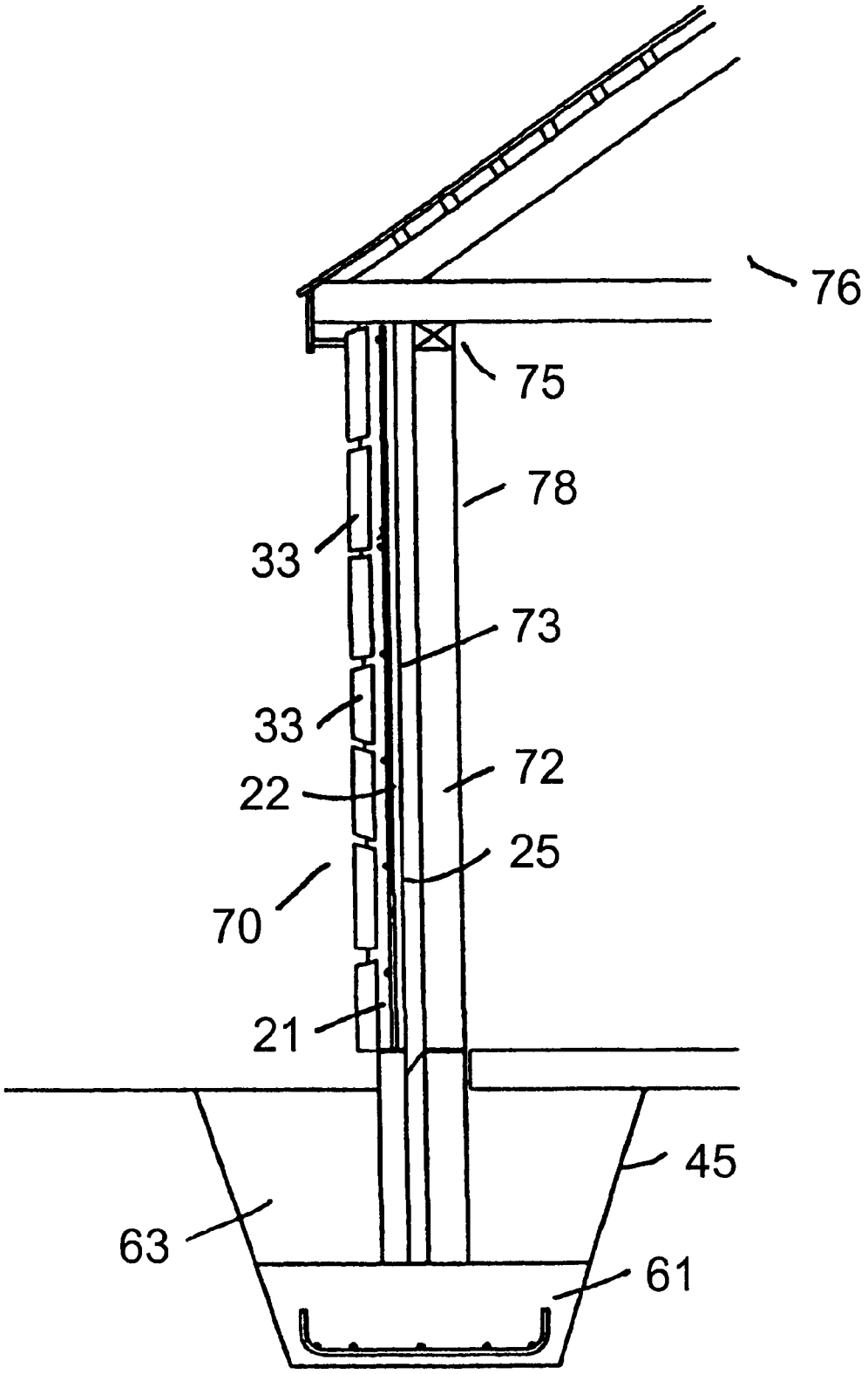
FIG. 14 is a sectional view corresponding to FIG. 4 of a wall element of the invention incorporated in a house as an exterior wall of the house.
Figure 15:
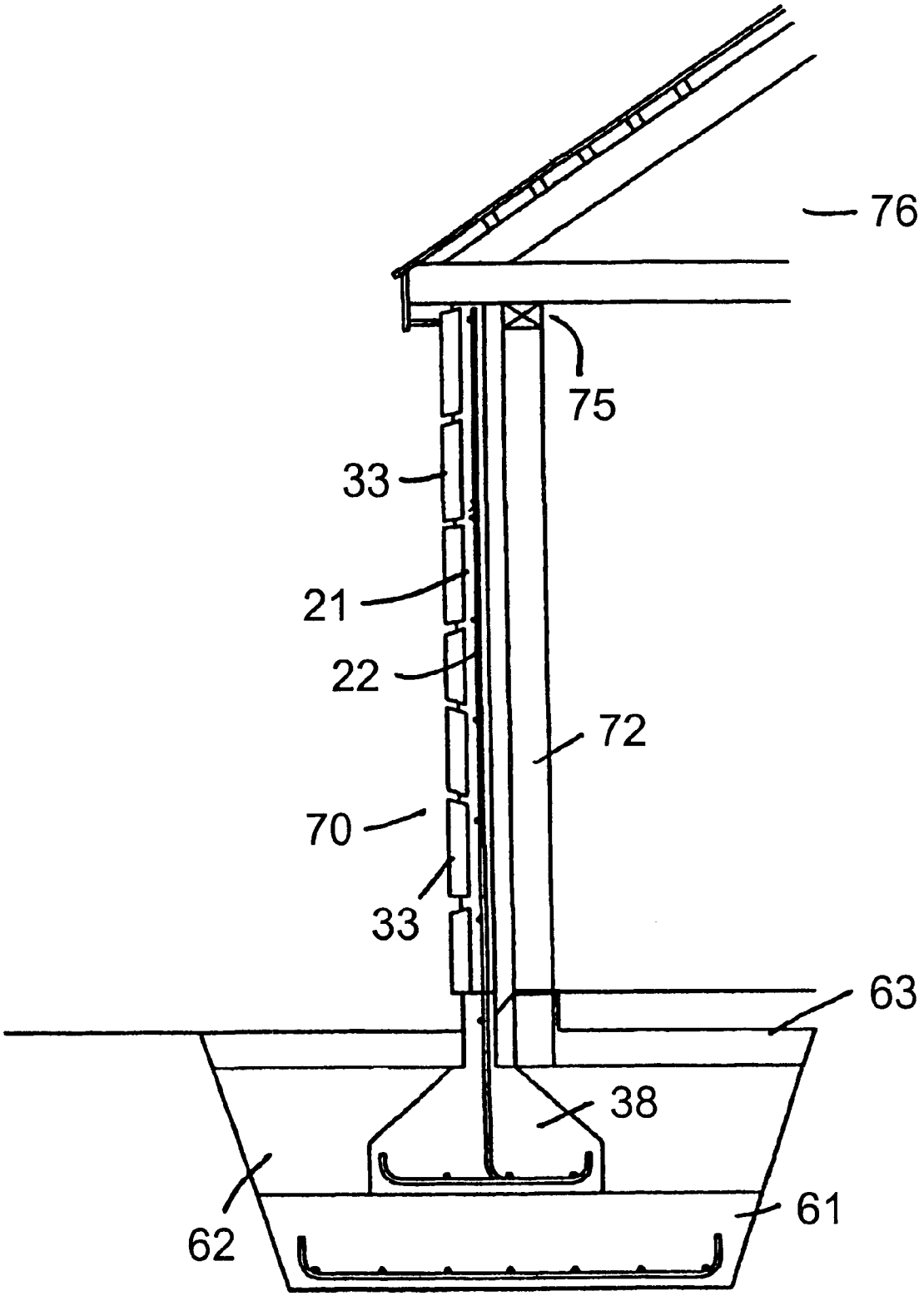
FIG. 15 is a sectional view corresponding to FIG. 5 showing the wall element of FIG. 14.

Referring now to FIG. 14 and 15, there is shown another wall element 70 used as an external wall for a domestic house. Parts similar to those described previously are assigned the same reference numerals. A block wall panel 72 is mounted inboard of the wall element 70 leaving a cavity 73 with insulation between the wall element 70 and wall panel 72. A wall plate 75 is mounted at an upper end of the wall panel 72 supporting a roof structure indicated generally at 76. If desired, the block wall panel 72 could be manufactured in a similar fashion to the wall element 70 with, in this case, the inside face 78 being arranged to simulate a block or brick wall.

The invention is not limited to the embodiments hereinbefore described which may be varied in both construction and detail within the scope of the appended claims.

What is claimed is:

1. A prefabricated modular wall element, including:

a precast reinforced concrete wall panel, said wall panel having a front face, a rear face, end faces, a top and a bottom, a plurality of individual slabs of stone or brick, each slab being partially embedded in said wall panel and projecting outwardly from said front face of the wall panel, the slabs being spaced apart on the wall panel having channels formed between outwardly projecting portions of adjacent slabs on the wall panel, said slabs being arranged on the wall panel such that the front of the wall element simulates a wall constructed of stone or brick according to the type of slabs embedded in the wall panel, at least two ground-engaging support legs being provided at the bottom of the wall panel, said support legs being spaced apart, each of said support legs projecting forwardly of the front face of the wall panel and projecting rearwardly of the rear face of the wall panel.

2. A modular wall element as claimed in claim 1 wherein two support legs are provided and are spaced inwardly from the end faces of the wall panel.

3. A modular wall element as claimed in claim 1 wherein the support legs are integrally formed with the wall panel.

4. A modular wall element as claimed in claim 1 wherein a plurality of said slabs are provided at the rear face of the wall panel, said slabs being partially embedded in the wall panel and projecting outwardly from said rear face of the wall panel, the slabs being spaced apart on the wall panel having channels formed between outwardly projecting portions of adjacent slabs on the wall panel, said slabs being arranged on the wall panel such that the rear of the wall element simulates a wall constructed of stone or brick according to the type of slabs embedded in the wall panel.

5. A modular wall element as claimed in claim 1 wherein the wall element has means for interlocking a pair of wall elements end to end.

6. A modular wall element as claimed in claim 5 wherein said interlocking means is a tongue and groove joint, a tongue being provided along one end face of the wall panel and an associated groove being provided at an opposite end face of the wall panel.

7. A modular wall element as claimed in claim 1 wherein grouting is provided in the channels formed between outwardly projecting portions of the slabs on the wall panel.

8. A modular wall element as claimed in claim 1 wherein a capping element is provided for engagement with a top of the wall panel.

9. A prefabricated modular wall element, including:

a precast reinforced concrete wall panel, said wall panel having a front face, a rear face, end faces, a top and a bottom, a plurality of individual slabs of stone or brick, each slab being partially embedded in said wall panel and projecting outwardly from said front face of the wall panel, the slabs being spaced apart on the wall panel having channels formed between outwardly projecting portions of adjacent slabs on the wall panel, said slabs being arranged on the wall panel such that the front of the wall element simulates a wall constructed of stone or brick according to the type of slabs embedded in the wall panel, two ground-engaging support legs being provided at the bottom of the wall panel, said support legs being integrally formed with the wall panel, said support legs being spaced apart, each of said support legs projecting forwardly of the front face of the wall panel and projecting rearwardly of the rear face of the wall panel.

10. A modular wall element as claimed in claim 9 wherein a plurality of said slabs are provided at the rear face of the wall panel, said slabs being partially embedded in the wall panel and projecting outwardly from said rear face of the wall panel, the slabs being spaced apart on the wall panel having channels formed between outwardly projecting portions of adjacent slabs on the wall panel, said slabs being arranged on the wall panel such that the rear of the wall element simulates a wall constructed of stone or brick according to the type of slabs embedded in the wall panel.

11. A modular wall element as claimed in claim 9 wherein the wall element has means for interlocking a pair of the wall elements end to end.

12. A modular wall element as claimed in claim 11 wherein said interlocking means is a tongue and groove joint, a tongue being provided along one end face of the wall panel and an associated groove being provided at an opposite end face of the wall panel.

13. A modular wall element as claimed in claim 9 wherein grouting is provided in the channels formed between outwardly projecting portions of the slabs on the wall panel.

14. A modular wall element as claimed in claim 9 wherein a capping element is provided for engagement with a top of the wall panel.

15. A prefabricated modular wall element, including:

a precast reinforced concrete wall panel, said wall panel having a front face, a rear face, end faces, a top and a bottom, a plurality of individual slabs of stone or brick, each slab being partially embedded in said wall panel and projecting outwardly from said front face of the wall panel, the slabs being spaced apart on the wall panel having channels formed between outwardly projecting portions of adjacent slabs on the wall panel, said slabs being arranged on the wall panel such that the front of the wall element simulates a wall constructed of stone or brick according to the type of slabs embedded in the wall panel, a plurality of downwardly projecting legs at the bottom of the wall panel, said legs being intergrally formed with said wall panel, said legs being spaced apart having slots formed between the legs for keying with a wall foundation.

16. A modular wall element as claimed in claim 15 wherein a plurality of said slabs are provided at the rear face of the wall panel, said slabs being partially embedded in the wall panel and projecting outwardly from said rear face of the wall panel, the slabs being spaced apart on the wall panel having channels formed between outwardly projecting portions of adjacent slabs on the wall panel, said slabs being arranged on the wall panel such that the rear of the wall element simulates a wall constructed of stone or brick according to the type of slabs embedded in the wall panel.

17. A modular wall element as claimed in claim 15 wherein the wall element has means for interlocking a pair of the wall elements end to end.

18. A modular wall element as claimed in claim 17 wherein said interlocking means is a tongue and groove joint, a tongue being provided along one end face of the wall panel and an associated groove being provided at an opposite end face of the wall panel.

19. A modular wall element as claimed in claim 15 wherein grouting is provided in the channels formed between outwardly projecting portions of slabs on the wall panel.

20. A modular wall element as claimed in claim 15 where a capping element is provided for engagement with a top of the wall panel.

* * * * *